US006213591B1

(12) United States Patent
Suetsugu et al.

(10) Patent No.: US 6,213,591 B1
(45) **Date of Patent: *Apr. 10, 2001**

(54) INJET RECORDING APPARATUS

(75) Inventors: Junichi Suetsugu; Kazuo Shima; Ryosuke Uematsu; Tadashi Mizoguchi; Hitoshi Minemoto; Hitoshi Takemoto; Yoshihiro Hagiwara; Toru Yakushiji, all of Niigata (JP)

(73) Assignee: NEC Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/877,483

(22) Filed: Jun. 17, 1997

(30) Foreign Application Priority Data

| | | |
|---|---|---|
| Jun. 17, 1996 | (JP) | 8-155989 |
| Jul. 29, 1996 | (JP) | 8-198794 |
| Jul. 31, 1996 | (JP) | 8-202362 |

(51) Int. Cl.[7] ..... B41J 2/06
(52) U.S. Cl. ..... 347/55
(58) Field of Search ..... 347/55, 120, 123, 347/111, 159, 141, 151, 127, 128, 17, 103, 154; 399/271, 290, 292, 293, 294, 295

(56) References Cited

U.S. PATENT DOCUMENTS

| | | | |
|---|---|---|---|
| 4,806,956 | 2/1989 | Nishikawa et al. . | |
| 5,144,340 | 9/1992 | Hotomi et al. . | |
| 5,754,199 * | 5/1998 | Miki et al. | 347/55 |
| 5,874,972 * | 2/1999 | Suetsugu et al. | 347/55 |

FOREIGN PATENT DOCUMENTS

| | | |
|---|---|---|
| 703080 | 3/1996 | (EP) . |
| 703081 | 3/1996 | (EP) . |
| 771654 | 5/1997 | (EP) . |
| 786344 | 7/1997 | (EP) . |
| 60-228162 | 11/1985 | (JP) . |
| 93/11866 | 6/1993 | (WO) . |

* cited by examiner

*Primary Examiner*—John Barlow
*Assistant Examiner*—Raquel Yvette Gordon
(74) *Attorney, Agent, or Firm*—Ostrolenk, Faber, Gerb & Soffen, LLP

(57) ABSTRACT

An inkjet recording apparatus includes an insulating support member having a major surface on which a plurality of ejection electrodes are formed with each of the ejection electrodes protruding from an ejection end of the insulating support member. Each of the ejection electrodes is coated with an insulating material. Further, a cover member is provided to cover the insulating support member to form ink chambers between them and an opening at an ejection end of the cover member. The ejection portion of each ejection electrode protrudes from the ejection end of the cover member through the opening. The ink is supplied from one ink chamber to the ejection electrodes and flows into the other ink chamber through the ejection electrodes.

24 Claims, 15 Drawing Sheets

INJET RECORDING APPARATUS

BACKGROUND OF THE INVENTION

1. Field of the Invention

The present invention relates to an apparatus employing an inkjet recording method, and more particularly to an apparatus that ejects particulate matter such as pigment matter and toner matter by making use of an electric field.

2. Description of the Related Art

There has recently been a growing interest in non-impact recording methods, because noise while recording is extremely small to such a degree that it can be neglected. Particularly, inkjet recording methods are extremely effective in that they are structurally simple and that they can perform high-speed recording directly onto ordinary medium. One inkjet recording method there is an electrostatic inkjet recording method.

The electrostatic inkjet recording apparatus generally has an electrostatic inkjet recording head and a counter electrode which is disposed behind the recording medium to form an electric field between it and the recording head. The electrostatic inkjet recording head has an ink chamber which temporarily stores ink containing toner particles and a plurality of ejection electrodes formed near the end of the ink chamber and directed toward the counter electrode. The ink near the front end of the ejection electrode forms a concave meniscus due to its surface tension, and consequently, the ink is supplied to the front end of the ejection electrode. If positive voltage relative to the counter electrode is supplied to a certain ejection electrode of the head, then the particulate matter in ink will be moved toward the front end of that ejection electrode by the electric field generated between the ejection electrode and the counter electrode. When the coulomb force due to the electric field between the ejection electrode and the counter electrode considerably exceeds the surface tension of the ink liquid, the particulate matter reaching the front end of the ejection electrode is jetted toward the counter electrode as an agglomeration of particulate matter having a small quantity of liquid, and consequently, the jetted agglomeration adheres to the surface of the recording medium. Thus, by applying pulses of positive voltage to a desired ejection electrode, agglomerations of particulate matter are jetted in sequence from the front end of the ejection electrode, and printing is performed. A recording head such as this is disclosed, for example, in Japan Laid-Open Patent Publication No. 60-228162 and PCT International Publication No. WO93/11866.

Particularly, in the Publication (60-228162), there is disclosed an electrostatic inkjet printer head where a plurality of ejection electrodes are disposed in an ink nozzle, and the front end of each ejection electrode is formed on the projecting portion of a head base which projects from the ink nozzle. The front end of this projecting portion has a pointed configuration, and the ejection electrode is formed in accordance with the direction of the pointed end. An ink meniscus is formed near the front end of the ejection electrode.

However, in the aforementioned conventional electrostatic inkjet recording heads, it is not easy to obtain high resolution, that is, a reduction in the pitch between the ejection electrodes and a fine printing dot. If the pitch between the ejection electrodes is reduced, the ink meniscus will flood the front end of the head base and an undesired ejection of ink will arise from a point differing from the ejection electrode to which a drive pulse signal was applied, and consequently, ejection cannot be performed with high reliability and stability.

SUMMARY OF THE INVENTION

It is an objective of the present invention to provide an apparatus which generates an agglomeration of particulate matter suitable for high resolution.

Another objective of the present invention is to provide an inkjet apparatus which is capable of stably ejecting ink from a plurality of ejection electrodes.

According to the present invention, an inkjet recording apparatus includes an insulating support member having a major surface on which a plurality of ejection electrodes formed with an ejection portion of each of the ejection electrodes protruding from an ejection end of the insulating support member. Each of the ejection electrodes is coated with an insulating material. The inkjet recording apparatus is further provided with a cover member for covering the insulating support member to form a space between them and an opening at an ejection end of the cover member, the ejection portion of each ejection electrode protruding from the ejection end of the cover member through the opening.

Since the ejection electrodes coated with the insulating material protrudes from the ejection end of the cover member through the opening, a reduction in the pitch between the ejection electrodes and a fine printing dot can be easily obtained. Further, since the ink containing particulate matter is supplied from the space within the cover member to the opening, the ink is stably supplied to the ejection electrodes, resulting in improved reliability of ink ejection.

BRIEF DESCRIPTION OF THE DRAWINGS

The above and other objects and advantages will become apparent from the following detailed description when read in conjunction with the accompanying drawings wherein.

DETAILED DESCRIPTION OF THE PREFERRED EMBODIMENTS

FIRST EMBODIMENT

Figure 1:
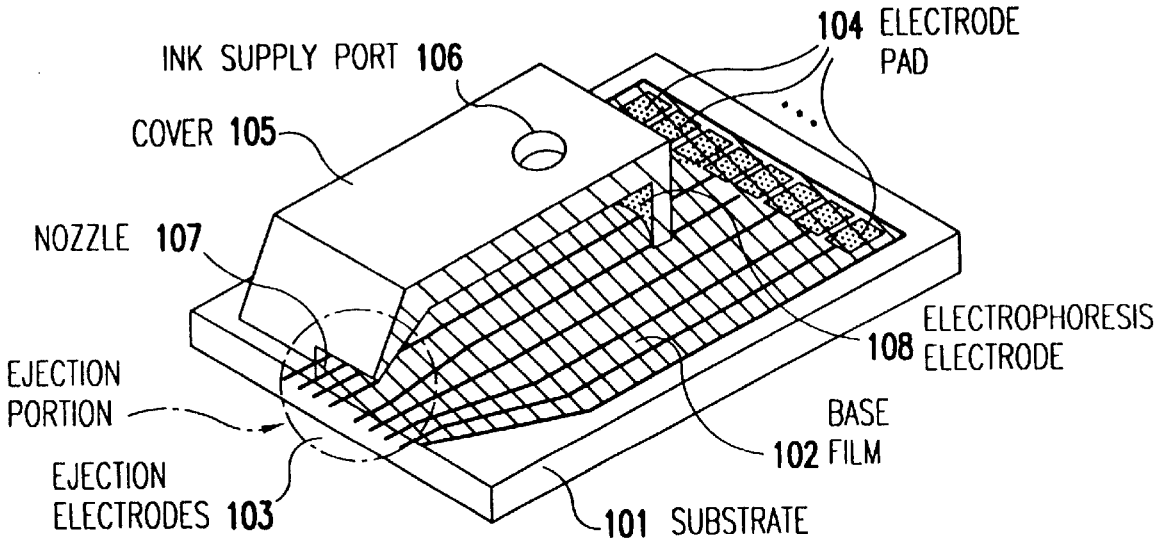
FIG. 1 is a part-fragmentary perspective view of an electrostatic inkjet recording head according to a first embodiment of the present invention.
Figure 2:
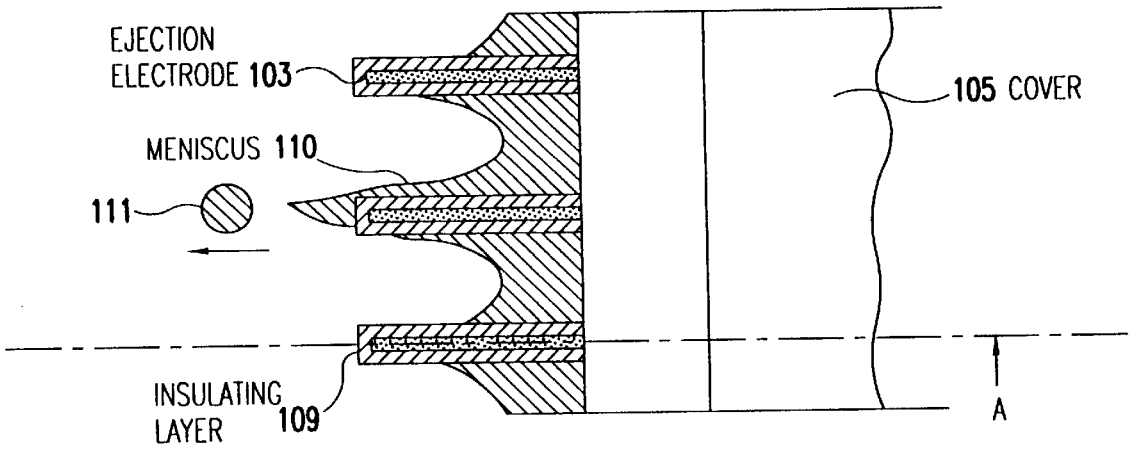
FIG. 2 is an enlarged part-plan view of the ink nozzle of the first embodiment shown in FIG. 1.
Figure 3:
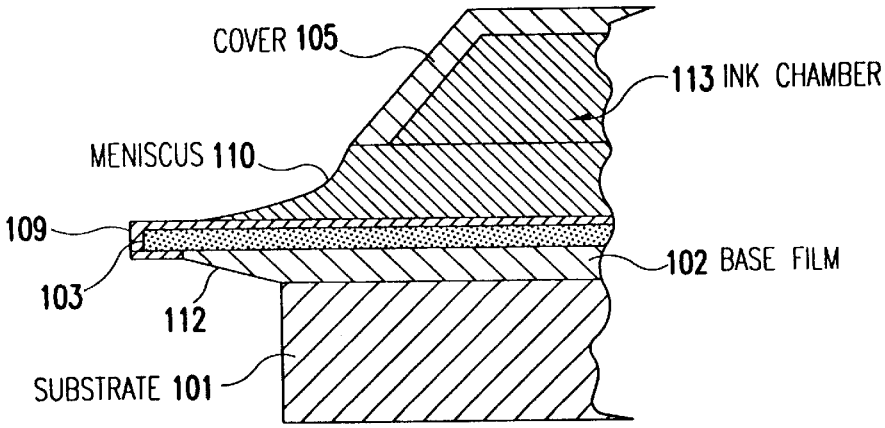
FIG. 3 is a sectional view of the ink nozzle in FIG. 2 taken substantially along line A—A of FIG. 2.

Referring now in greater detail to the drawings and initially to FIGS. 1 through 3, there is shown an electrostatic inkjet recording head in accordance with a first embodiment of the present invention. A substrate 101 is made of an insulator such as a plastic and has a base film 102 mounted thereon. The base film 102 is made of an insulator such as polyimide and has a thickness of about 50 $\mu$m. A plurality of ejection electrodes 103 are formed integrally on the base film 102 in accordance with a predetermined pattern. One end of each ejection electrode 103 protrudes from the substrate 101 and the base film 102 to form part of an ejection portion, while the other end is formed with an electrode pad 104. The ejection electrodes 103 are formed by plating the base film 102 with conductive material of about 20 to 30 $\mu$m thick in the predetermined pattern and are arranged with a pitch of 300 dpi, that is, at intervals of about 85 $\mu$m. The respective ejection electrodes 103 of the ejection portion protrude independently from the end face of the base film 102 by about 80 to 500 $\mu$m. The surface of the ejection electrode 103 is covered uniformly with an insulating layer 109 of about 10 $\mu$m thick, made of parylene resin.

A cover 105 made of an insulating material is attached to the substrate 101 having the base film 102 and the ejection electrodes 103 formed thereon. The cover 105 is formed with an ink supply port 106 and an ink discharge port (not shown). The space, defined by the base film 102 and the cover 105, constitutes an ink chamber 113. From the ink supply port 106, ink containing toner particles is filled into the ink chamber 113.

The front end of the cover 105 is cut out to form a slit-shaped ink nozzle 107 between the cover 105 and the base film 102. The aforementioned ejection portions of the ejection electrodes 103 are disposed in the ink nozzle 107. As shown in FIGS. 2 and 3, an ink meniscus 110 is formed among the ejection portions of the ejection electrodes 103 in the ink nozzle 107.

At the inner rear end of the cover 105, an electrophoresis electrode 108 is provided in contact with the ink within the ink chamber 113. If voltage with the same polarity as toner particles is applied to the electrophoresis electrode 108, then an electric field will arise in the ink chamber 113 between the electrode 108 and a counter electrode (not shown) and toner particles will be moved toward the front end of the ejection portions of the ejection electrodes 103 due to an electrophoresis phenomenon.

The inkjet recording head in this embodiment is connected to an ink tank (not shown) through tubes (not shown), and a negative pressure of about 1 $cmH_2O$ is applied to forcibly circulate ink through the tubes. The ink is one where an electrification control agent and colored thermoplastic resin corpuscles (i.e., toner particles) are dispersed in a petroleum-base organic solvent such as an isoparaffin solvent. The toner particles are charged with an apparent positive polarity by a zeta ($\zeta$) potential.

The base film 102, as shown in FIG. 3, has a tapered support portion 112 so that part of the bottom portion of each ejection electrode 103 protruding from the base film 102 is reinforced, in order to reinforce the mechanical strength of the ejection electrode 103. As previously described, ink forms the ink meniscus 110 in the ink nozzle 107 by its surface tension. Since negative pressure is given to the ink within the ink chamber 113 and also the ejection electrodes 103 protrude from the base film 102 and the cover 105, the ink meniscus 110 has a concave configuration when viewed in a horizontal direction, as shown in FIG. 3. Also, because the ejection electrodes 103 individually protrude outside the ink nozzle 107, the ink meniscus 110 has a concave configuration between adjacent electrodes 103 when viewed in a vertical direction, as shown in FIG. 2.

For the above reason, when a high-voltage pulse signal is applied to one of the ejection electrodes 103, an electric field is concentrated on the protruding front end of the ink meniscus 110 of that ejection electrode 103. The charged toner particles in the ink are conducted by this electric field, then are pulled out of the protruding front end of the ink meniscus 110, and become a toner group 111. The toner group 111 is jetted toward a counter electrode (not shown) arranged in opposition to the recording head, that is, toward the recording medium such as a paper. The toner group, which adhered to the recording medium and formed a recording dot, is heated and fixed by means of a heater.

Figure 4:
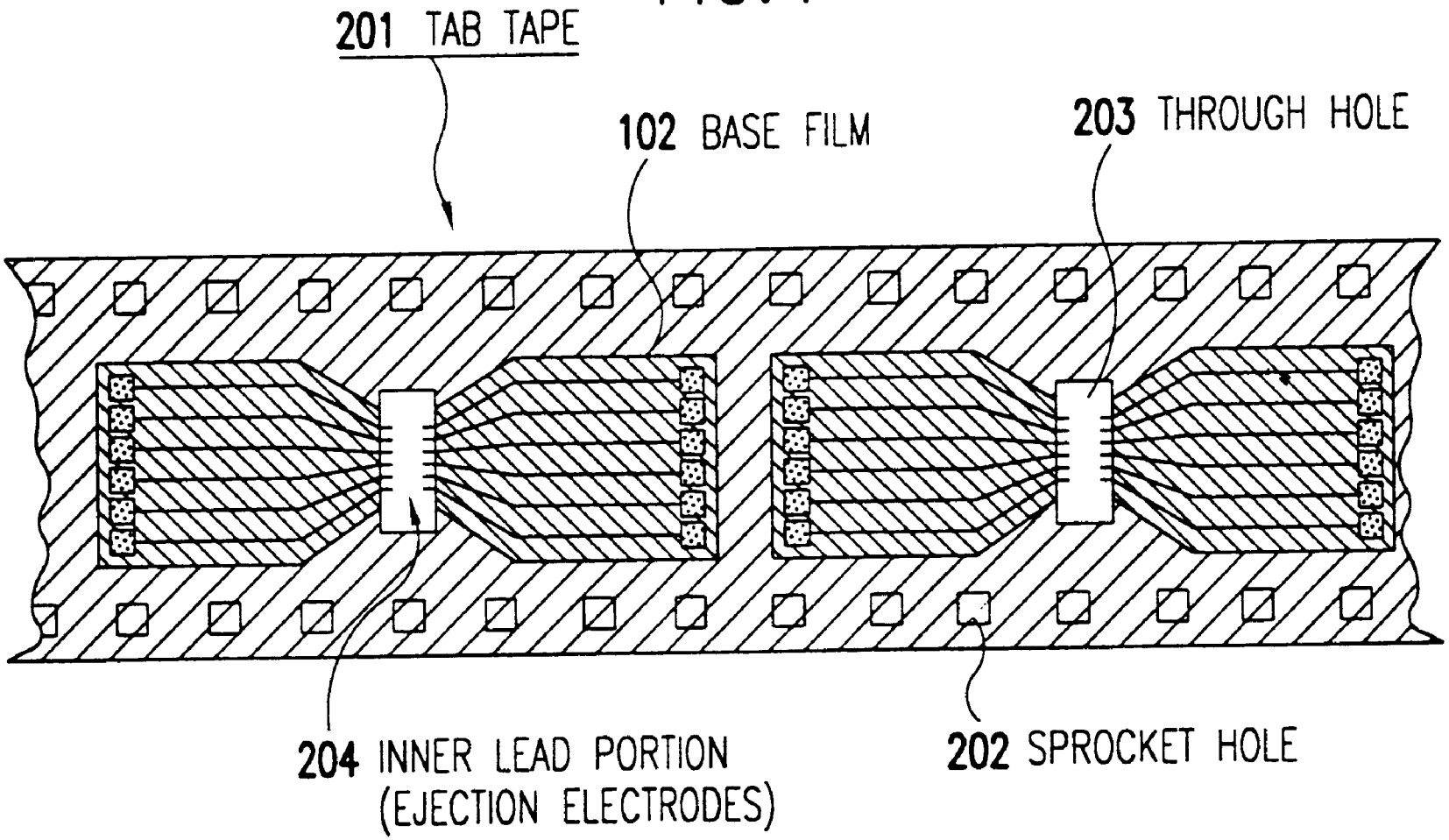
FIG. 4 is a schematic plan view of TAB (tape automated bonding) tape that is used in the first embodiment.

In reference to FIG. 4, a brief description will now be made of a method of fabricating TAB (tape automated bonding) tape 201 which is used in the first embodiment shown in FIGS. 1 through 3. Flash plating is first given to a tape-shaped polyimide base film having sprocket holes 202 at both ends. Then, a dry film is placed on top of the plated base film, and exposure and development are performed to form a predetermined pattern. Next, the base film is plated with copper (Cu) in accordance with the predetermined pattern and is etched to form through-holes 203. Thereafter, the photoresist film is removed and finish plating is given. Finally, parylene resin is chemically deposited on a required place to form the insulating layer 109. In this process, when the base film 102 is etched, the exposed inner lead portions 204 constitute the ejection electrodes 103. In this way, the base film 102 having the ejection electrodes 103 formed thereon is bonded fast to the substrate 101.

SECOND EMBODIMENT

Figure 5:
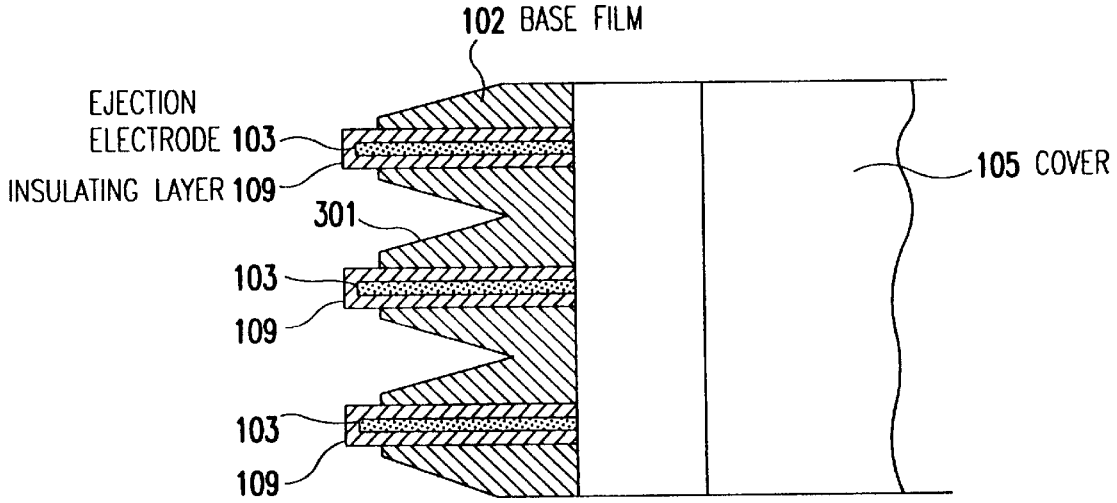
FIG. 5 is an enlarged part-plan view of the ink nozzle of an electrostatic inkjet recording head according to a second embodiment of the present invention.

FIG. 5 illustrates an electrostatic inkjet recording head constructed according to a second embodiment of the present invention, where elements similar to those previously described with reference to FIGS. 1–3 are denoted by the same reference numerals and the details of these elements are omitted. This embodiment is characterized in that a base film 102 has a flat, tapered support portion 301 for each ejection electrode 103 in order to reinforce the mechanical strength of ejection electrodes 103. Also, in this embodiment, patterning is performed so that the flat, tapered support portion 301 is formed when the base film 102 is etched to form through-holes as shown in FIG. 4. The front end of each ejection electrode 103 is disposed so as to protrude from the support portion 301 of the base film 102.

THIRD EMBODIMENT

Figure 6:
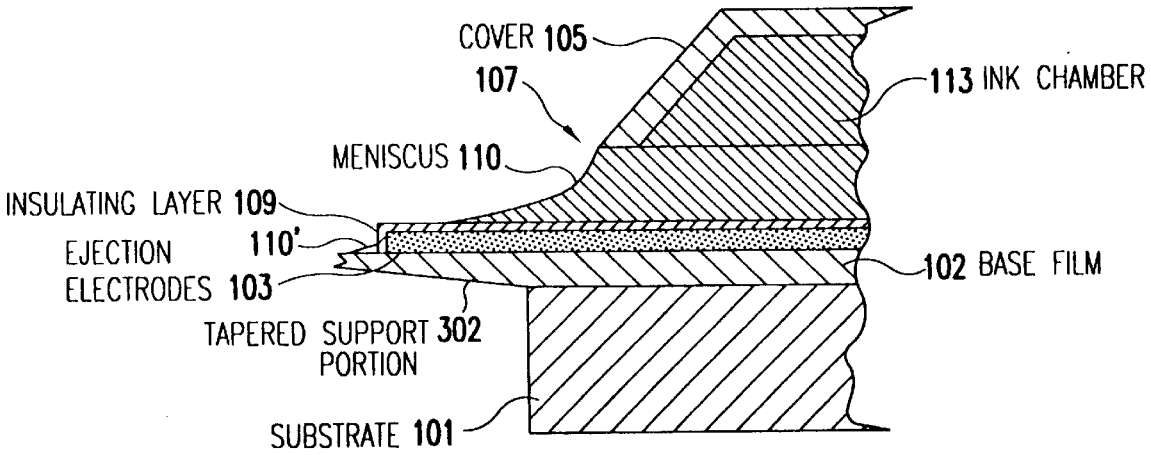
FIG. 6 is a sectional view of the ink nozzle of an electrostatic inkjet recording head according to a third embodiment of the present invention.

FIG. 6 illustrates an electrostatic inkjet recording head constructed according to a third embodiment of the present invention, where elements similar to those previously described with reference to FIGS. 1–3 are denoted by the same reference numerals and the details of these elements are omitted. In the figure, a base film 102 has a tapered support portion 302 so that part of the bottom portion of an ejection electrode 103 protruding from the base film 102 is supported, in order to reinforce the mechanical strength of the ejection electrode 103. Therefore, ink forms an upper ink meniscus 110 in an ink nozzle 107 between the front end of a cover 105 and the ejection electrode 103 by its surface tension and also forms a lower ink meniscus 1101 between the ejection electrode 103 and the tapered support portion 302. For this reason, when a high-voltage pulse signal is applied to an arbitrary ejection electrode 103, an electric field is concentrated on the protruding front end of the lower ink meniscus 110' of the support portion 302. The charged toner particles in the ink are conducted by this electric field, then are pulled out of the protruding front end of the lower ink meniscus 110', and become a toner group 111. The toner group 111 is jetted toward a counter electrode (not shown) arranged in opposition to the recording head, that is, toward the recording medium.

FOURTH EMBODIMENT

Figure 7:
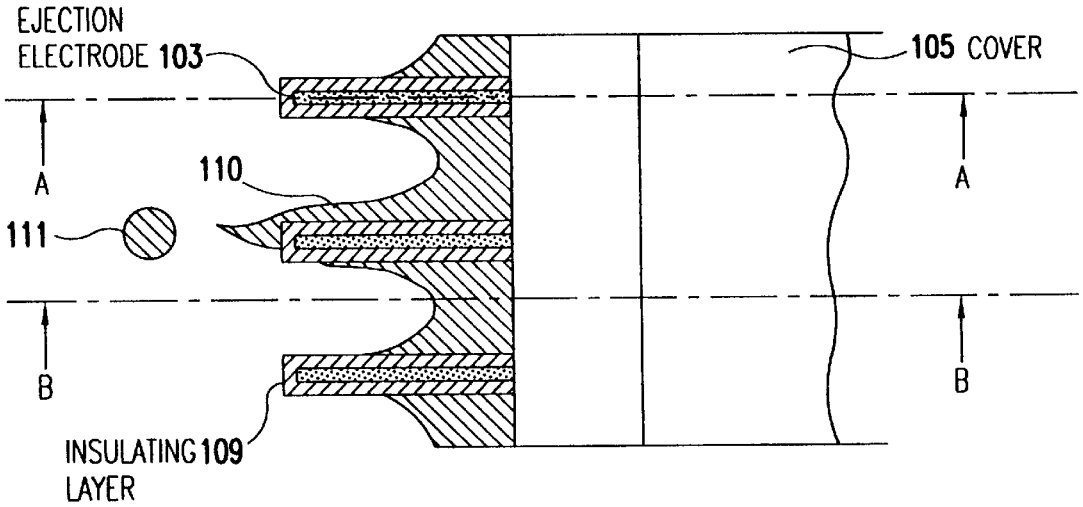
FIG. 7 is an enlarged part-plan view of the ink nozzle of an electrostatic inkjet recording head according to a fourth embodiment of the present invention.
Figure 8:
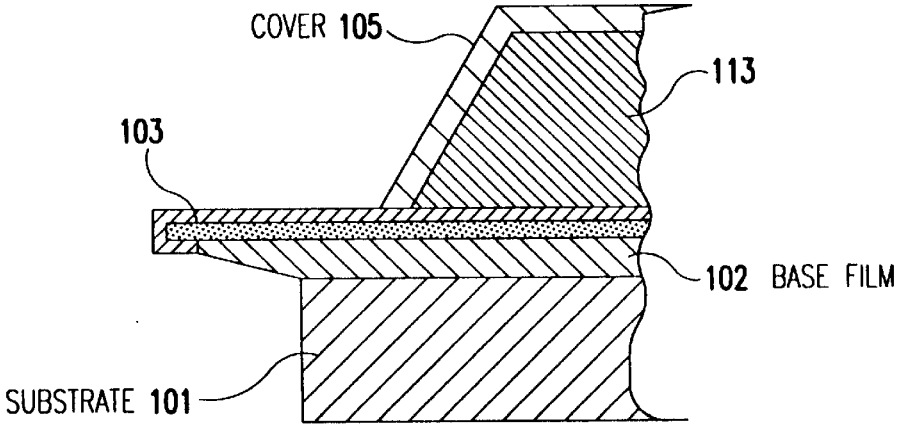
FIG. 8 is a sectional view of the ink nozzle in FIG. 7 taken substantially along line A—A of FIG. 7.
Figure 9:
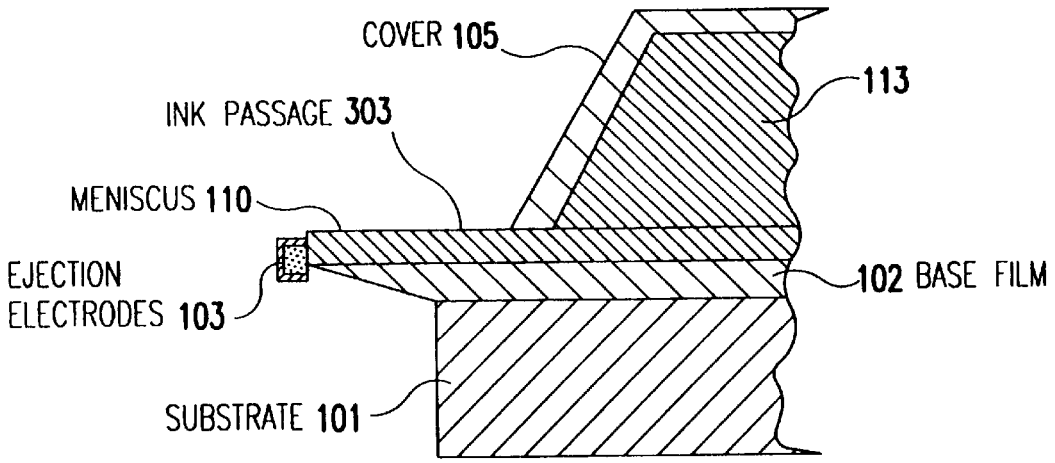
FIG. 9 is a sectional view of the ink nozzle in FIG. 7 taken substantially along line B—B of FIG. 7.

FIGS. 7 through 9 illustrate an electrostatic inkjet recording head constructed according to a fourth embodiment of the present invention, where elements similar to those previously described with reference to FIGS. 1–3 are denoted by the same reference numerals and the details of these elements are omitted. In the figures, a cover 105 is attached to a base film 102 at the position where the protruding portions of ejection electrodes 103 are not covered. The cover 105 is made of an insulating material and is previously formed with ink supply and discharge ports (not shown). The space between the base film 102 and the cover 105 constitutes an ink chamber 113, which is filled with ink supplied from the ink supply port. In this embodiment, the cover 105 is attached closely to the base film 102 without forming an opening therebetween. However, since the pattern for the electrode 103 on a base film 102 has a thickness of about 20 to 30 $\mu$m, the space between a portion having no pattern for the electrode 103 and the cover 105 constitutes an ink passage 303, as shown in FIG. 9. Each ink passage 303 forms an ink nozzle for the corresponding ejection electrode 103, and an ink meniscus is formed in the ink nozzle. Thus, in this embodiment the ink nozzle is formed without especially cutting out part of the front end of the cover 105.

According to the first through the fourth embodiments, the following advantages are obtained. A first advantage is that stable ejection from a designated ejection point alone can be performed. The reason for this is that since the front end of each ejection electrode 103 is used as an ejection portion and also the respective ejection electrodes 103 protrude independently from both the substrate 101 and the base film 102, toner particles flow smoothly between the ejection electrodes 103 and a meniscus is stably formed at all times for each ejection point.

A second advantage of the aforementioned embodiments is that the recording head is inexpensive. This is because the ejection electrode 103 of the recording head is formed by coating the inner lead of the tape which is employed in TAB with an insulating material.

A third advantage is that an increase in the mechanical strength of the ejection electrode 103 minimizes the bending of the ejection electrode and also makes stable ejection possible. This is because the ejection electrode 103 is supported from the bottom surface by part of the base film or TAB tape.

A fourth advantage is that toner particles flow smoothly near the ejection electrodes 103. The reason for this is that since the front end of the base film 102 projects from the front end of the ejection electrode (see FIG. 6), toner particles are not deposited between the base film 102 and the ejection electrode 103.

A fifth advantage is that the meniscus is always stable at the front end of the ejection electrode 103. The reason for this is that since the meniscus is also supported by the tapered support portion of the base film formed between the ejection electrodes (see FIGS. 5 and 6), the meniscus is hardly influenced by disturbance such as pressure fluctuation.

FIFTH EMBODIMENT

Figure 10:
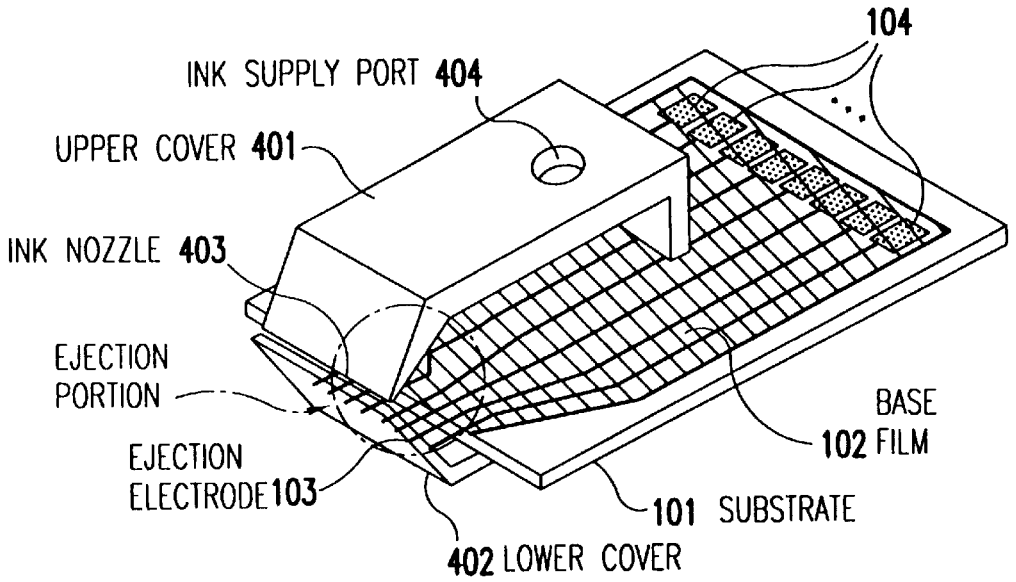
FIG. 10 is a part-fragmentary perspective view of an electrostatic inkjet recording head according to a fifth embodiment of the present invention.
Figure 11:
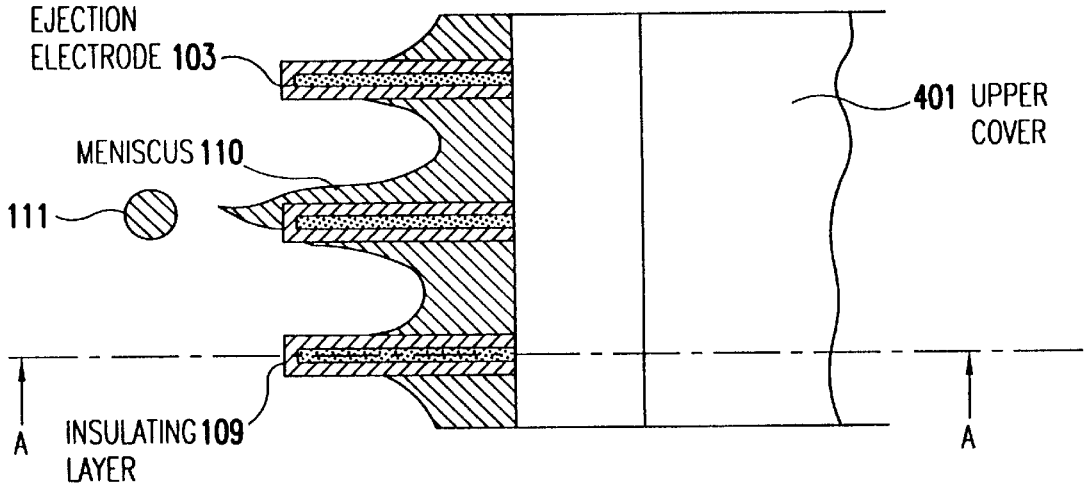
FIG. 11 is an enlarged part-plan view of the ink nozzle of the fifth embodiment shown in FIG. 10.
Figure 12:
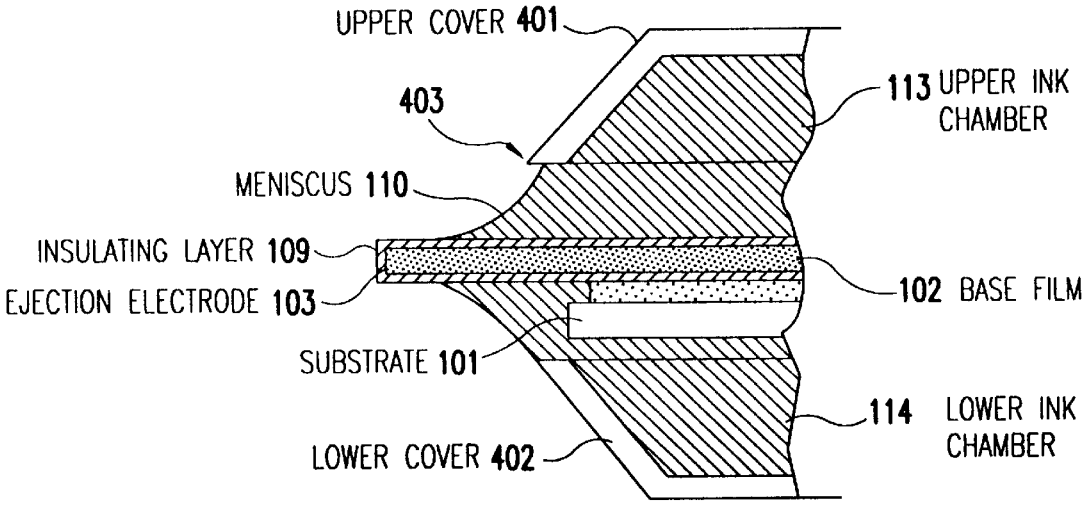
FIG. 12 is a sectional view of the ink nozzle in FIG. 11 taken substantially along line A—A of FIG. 11.

FIGS. 10 through 12 illustrate an electrostatic inkjet recording head constructed according to a fifth embodiment of the present invention. In the figures, a substrate 101 is made of an insulator such as a plastic and has a base film 102 mounted thereon. The base film 102 is made of an insulator such as polyimide and has a thickness of about 50 $\mu$m. A plurality of ejection electrodes 103 are formed integrally on the base film 102 in accordance with a predetermined pattern. One end of each ejection electrode 103 protrudes from the substrate 101 and the base film 102 and forms part of an ejection portion, while the other end is formed with an electrode pad 104 to which a drive voltage pulse signal is applied. The ejection electrodes 103 are formed by pattern-plating the base film 102 with conductive material such as copper (Cu) of about 20 to 30 $\mu$m thick. The ejection electrodes 103 are arranged, for example, with a pitch of 300 dpi, that is, at intervals of about 85 $\mu$m. The respective ejection electrodes 103 of the ejection portion protrude independently from the end face of the substrate 101 and the base film 102 by about 80 to 500 $\mu$m. The surface of each ejection electrode 103 is covered uniformly with an insulating layer 109 of about 10 $\mu$m thick, made of parylene resin.

An upper cover 401 and a lower cover 402 consisting of an insulating material are attached to the top surface and the bottom surface of the substrate 101 having both the base film 102 and the ejection electrodes 103 formed thereon. The front ends of the upper and lower covers 401 and 402 are formed with slit-shaped gaps, which constitute an ink nozzle 403. The front ends of the upper cover 401 and the lower cover 402, as shown in FIG. 12, are disposed at a position where the ejection electrodes 103 protruding from the substrate 101 and the base film 102 are interposed between the upper and lower covers and where the front end of each ejection electrode 103 is not covered with the upper and lower covers. In other words, the front ends of a plurality of ejection electrodes 103, arranged in a row, protrude from the substrate 101 and the base film 102 and further protrude outside the recording head through the slit-shaped ink nozzle 403 formed between the front ends of the upper and lower covers 401 and 402.

The upper cover 401 is formed with an ink supply port 404, while the lower cover 402 is formed with an ink discharge port (not shown). The space, defined by the base film 102 and the upper cover 401, constitutes an upper ink chamber 113. The upper ink chamber 113 is filled with ink containing toner particles supplied from the ink supply port 406. The space, defined by the base film 102 and the lower cover 402, constitutes a lower ink chamber 114. The ink, filled in the upper ink chamber 113, passes between the ejection electrodes 103 arranged in the form of a grid in the vicinity of the ink nozzle 403, then flows into the lower ink chamber 114, and finally is discharged from the ink discharge port (not shown).

The inkjet recording head according to the fifth embodiment as shown in FIGS. 10 through 12 is connected to an ink tank (not shown) through tubes (not shown), and a negative pressure of 1 $cmH_2O$ is applied to forcibly circulate ink through the tubes. The ink is one where an electrification control agent and colored thermoplastic resin corpuscles (i.e., toner particles) are dispersed in a petroleum-base organic solvent such as an isoparaffin solvent. The toner particles are charged with an apparent positive polarity by a zeta ($\zeta$) potential.

The ink within the ink chambers 113 and 114 forms an ink meniscus 110 in the ink nozzle 403 by its surface tension. Since negative pressure is given to the ink within the ink chambers and also the ejection electrodes 103 protrude from the substrate 101, the base film 102, the upper cover 401 and the lower cover 402, the ink meniscus 110 on the side of the upper cover 401 has a concave configuration when viewed in a horizontal direction, as shown in FIG. 12. Likewise, the ink meniscus 110 on the side of the lower cover 402 also has a concave configuration. These concave configurations are substantially symmetrical with respect to the ejection electrode 103. Furthermore, because the ejection electrodes 103 individually protrude outside the ink nozzle 107, the ink meniscus 110 has a concave configuration between adjacent electrodes 103 when viewed in a vertical direction, as shown in FIG. 11. For this reason, when a high-voltage pulse signal is applied to any one of the ejection electrodes 103, an electric field is concentrated on the protruding front end of the ink meniscus 110 of that ejection electrode 103. The charged toner particles in the ink are conducted by this electric field, then are pulled out of the protruding front end of the ink meniscus 110, and become a toner group 111. The toner group 111 is jetted toward a counter electrode (not shown) arranged in opposition to the recording head, that is, toward the recording medium. The toner group, which adhered to the recording medium and formed a recording dot, is heated and fixed by means of a heater.

Figure 13:
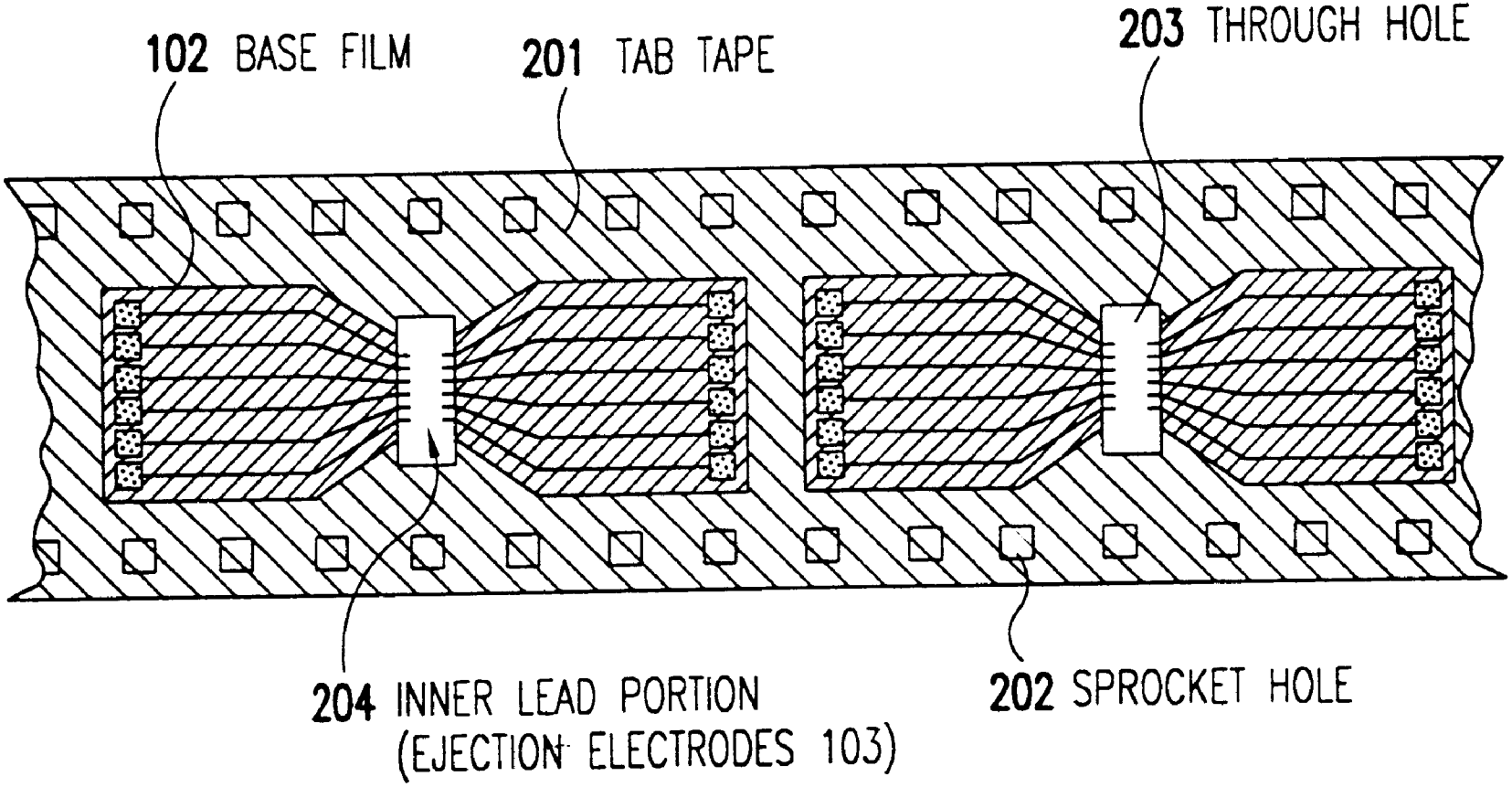
FIG. 13 is a schematic plan view of TAB tape that is used in the fifth embodiment.

In reference to FIG. 13, a brief description will be made of a method of fabricating TAB tape 201 which is used in the fifth embodiment shown in FIGS. 10 through 12. Flash plating is first given to a tape-shaped polyimide base film having sprocket holes 202 at both ends. Then, a dry film is placed on top of the plated base film, and exposure and development are performed to form a predetermined pattern. Next, the base film is plated with copper (Cu) in accordance with the predetermined pattern and is etched to form through holes 203. Thereafter, the photoresist film is removed and finish plating is given. Finally, parylene resin is chemically deposited on a required place to form the insulating layer 109. In this process, when the base film 102 is etched, the exposed inner lead portions 204 form the ejection electrodes 103.

SIXTH EMBODIMENT

Figure 14:
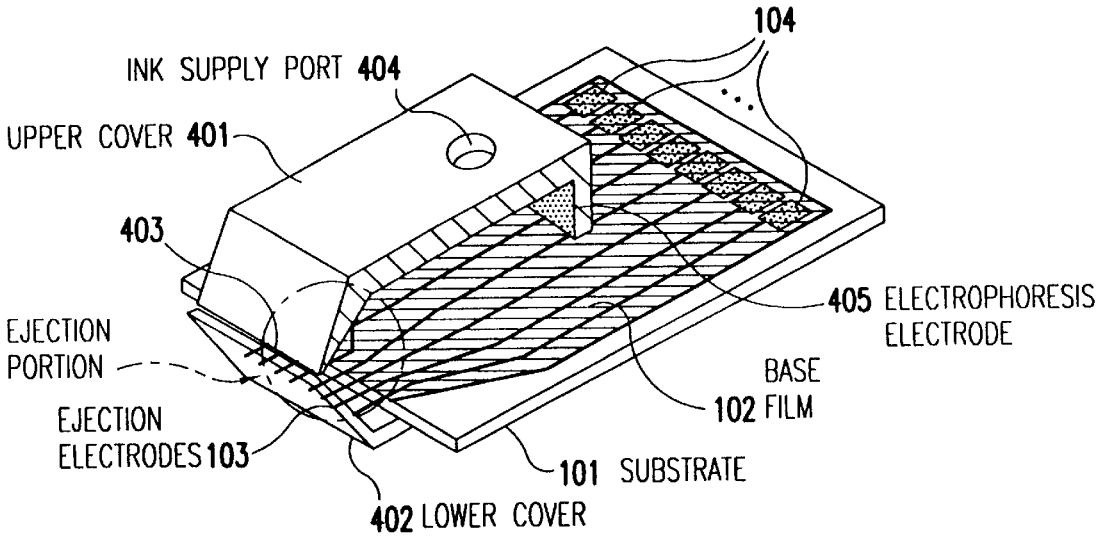
FIG. 14 is a part-fragmentary perspective view of an electrostatic inkjet recording head according to a sixth embodiment of the present invention.
Figure 15:
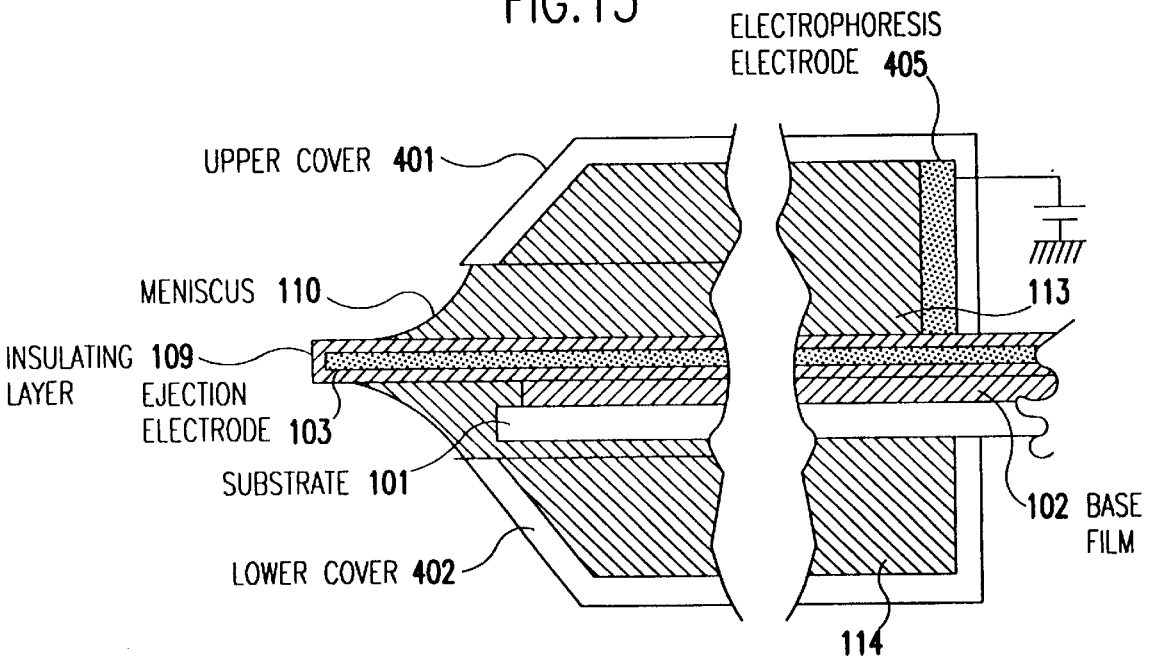
FIG. 15 is a part-sectional view showing the structure of the sixth embodiment shown in FIG. 14.

FIGS. 14 and 15 illustrate an electrostatic inkjet recording head constructed according to a sixth embodiment of the present invention, where elements similar to those previously described with reference to FIGS. 10–12 are denoted by the same reference numerals and the details of these elements are omitted. In this embodiment, in addition to the fifth embodiment, an electrophoresis electrode 405 is provided in contact with ink on the inner rear end of an upper cover 401. The electrophoresis electrode 405 is given voltage with the same polarity as the potential of the toner particles and moves the toner particles in the ink, supplied from an ink supply port 404, to the vicinity of an ejection electrode 103 along the electric field generated in the upper ink chamber 113 between the electrophoresis electrode 405 and a counter electrode (not shown) by an electrophoresis phenomenon. For this reason, in addition to the supply of the toner particles to the vicinity of the ink nozzle 403 through the compulsory ink circulation performed by a pump, because of the movement of the toner particles caused by the electrophoresis phenomenon, the concentration of the toner particles becomes relatively higher in the vicinity of the ink nozzle 403 than in the upstream side of the ink chamber. Therefore, when a high-voltage pulse signal is applied to any one of the ejection electrodes 103, the charged toner particles in the ink are conducted by the electric field generated in this ejection electrode 103 and become a sufficient quantity of toner group 111. The toner group 111 is jetted toward a counter electrode (not shown) arranged in opposition to the recording head, that is, toward the recording medium. At this time, the ink passes through the gaps between the ejection electrodes 103 and is discharged forcibly to the ink discharge port (not shown) along with an excess of toner particles.

Figure 16:
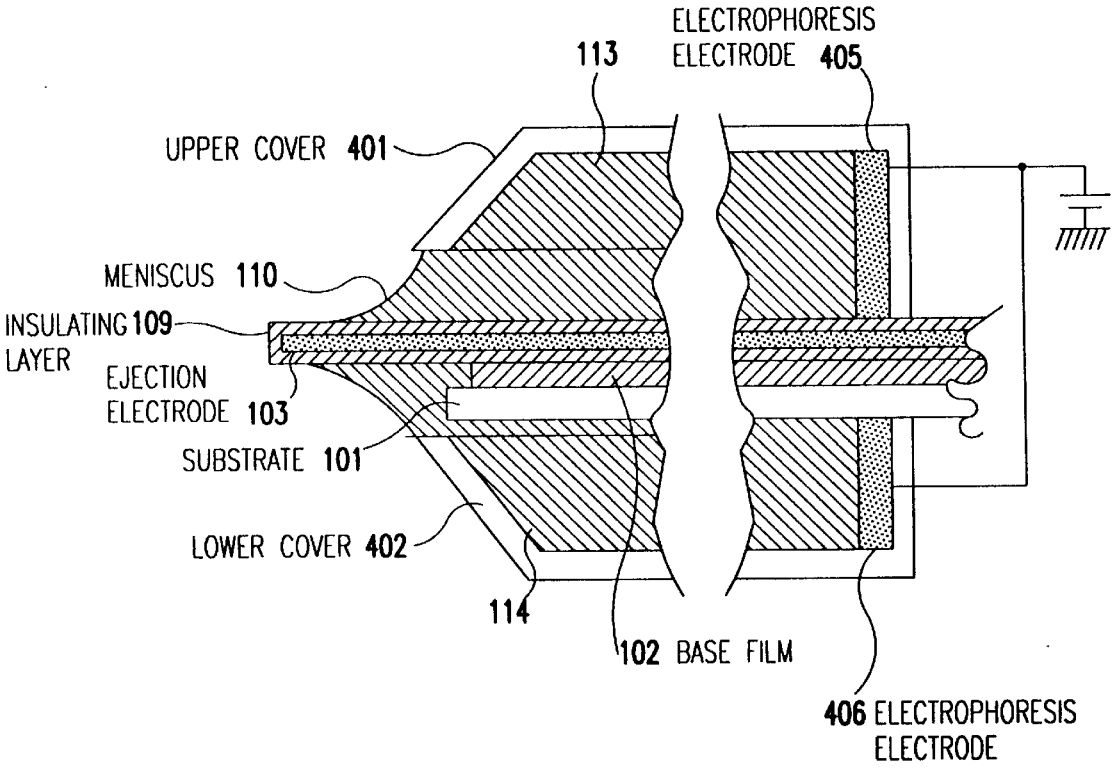
FIG. 16 is a part-sectional view showing another structure of the sixth embodiment shown in FIG. 14.

FIG. 16 illustrates another structure of the sixth embodiment. In addition to the structure of the fifth embodiment, an upper electrophoresis electrode 405 and a lower electrophoresis electrode 406 are provided in contact with ink on the inner rear ends of upper and lower covers 401 and 402, respectively. The upper and lower electrophoresis electrodes 405 and 406 are electrically connected with each other. The electrophoresis electrodes 405 and 406 are given voltage having the same polarity as the potential of the toner particles and move the toner particles in the ink, supplied from an ink supply port 404, to the vicinity of an electrode 103 along the electric field generated between the electrophoresis electrode 405 (and 406) and a counter electrode (not shown) by an electrophoresis phenomenon. For this reason, in addition to the supply of the toner particles to the vicinity of the ink nozzle 403 through the compulsory ink circulation performed with a pump, because of the movement of the toner particles caused by the electrophoresis phenomenon, the concentration of the toner particles becomes relatively higher in the vicinity of the ink nozzle 403 than in the upstream side of the ink chamber. In addition, toner particles move in an opposite direction to the movement of counter ion toner particles having an opposite polarity to the electric charge of toner particles which is generated when the toner particles are moved by the electrophoresis phenomenon. The counter ion toner particles adhere to the electrophoresis electrodes 405 and 406. Therefore, when a high-voltage pulse signal is applied to any one of the ejection electrodes 103, the charged toner particles in the ink are conducted by the electric field generated in this ejection electrode 103 and become a sufficient quantity of toner group 111. The toner group 111 is jetted toward a counter electrode (not shown) arranged in opposition to the recording head, that is, toward the recording medium. At this time, an excess of toner particles not jetted and the counter ions pass through the gaps between the electrodes 103 and are discharged forcibly to the ink discharge port (not shown).

SEVENTH EMBODIMENT

Figure 17:
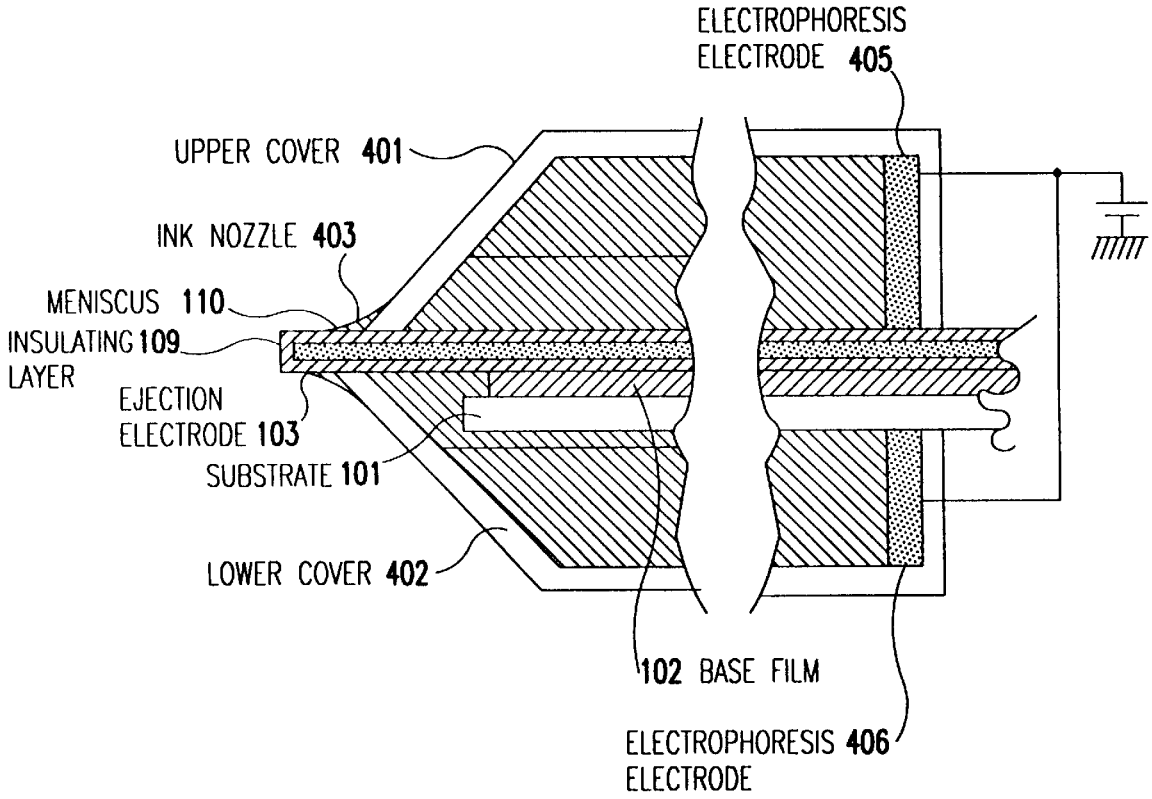
FIG. 17 is a part-sectional view showing the structure of an electrostatic inkjet recording head according to a sixth embodiment of the present invention.
Figure 18:
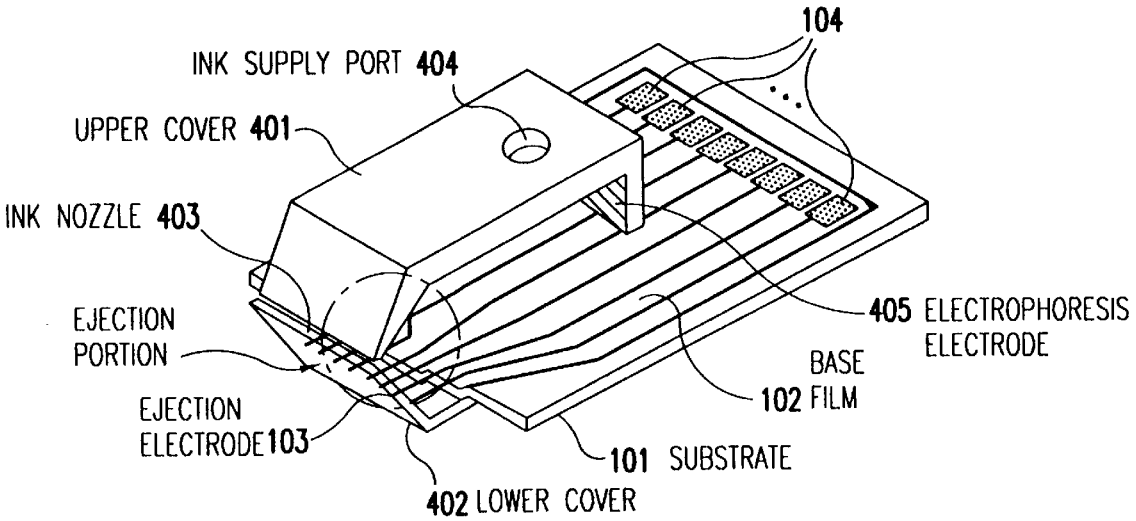
FIG. 18 is a part-fragmentary perspective view of an electrostatic inkjet recording head according to an eighth embodiment of the present invention.

FIG. 17 illustrates an electrostatic inkjet recording head constructed according to a seventh embodiment of the present invention, where elements similar to those previously described with reference to FIGS. 14–16 are denoted by the same reference numerals and the details of these elements are omitted. This embodiment is constructed so that the front ends of an upper cover 401 and a lower cover 402 are attached closely to an array of the ejection electrodes 103. Since the pattern for the ejection electrodes 103 on a base film 102 has a thickness of about 20 to 30 $\mu$m, the space between a portion having no pattern for the ejection electrode 103 and the upper cover 401 constitutes an upper ink passage. Similarly, a lower ink passage is formed on the side of the lower cover 402. The upper ink passage constitutes an ink nozzle 403, and an ink meniscus 110 is formed in the ink nozzle 403. Thus, the ink passages and the ink nozzle are formed without especially processing the front ends of the upper and lower covers 401 and 402.

In the fifth through the seventh embodiments, reliable toner ejection is obtainable regardless of printing conditions. The reason for this is that since ink is passed through the gaps between ejection electrodes so that an excess of toner particles and counter ions is forcibly discharged from the vicinity of the ejection electrodes, stable toner particles are always supplied to the vicinity of the ejection electrodes.

EIGHTH EMBODIMENT

FIGS. 18 through 21 illustrate an electrostatic inkjet recording head constructed according to an eighth embodiment of the present invention. In the figures, a substrate 101 is made of an insulator such as a plastic and has a base film 102 mounted thereon. The base film 102 is made of an insulator such as polyimide and has a thickness of about 50 $\mu$m. A plurality of ejection electrodes 103 are formed integrally on the surface of the base film 102. The front end portion of the base film 102 is divided into a plurality of groups so that a predetermined number of ejection points are determined for each group. As described later, slits are formed on the ejection side of the base film 102, and according to the shape of the teeth of a saw of the substrate 101, the front end portion of the base film 102 is divided into a plurality of groups.

The ejection electrodes 103 are formed by pattern-plating the base film 102 with conductive material such as copper (Cu) of about 20 to 30 $\mu$m thick. The ejection electrodes 103 are arranged, for example, with a pitch of 300 dpi, that is, at intervals of about 85 $\mu$m. Also, the respective ejection electrodes 103 protrude independently from the front end faces of the substrate 101 and the base film 102, and the quantity of protrusion is about 80 to 500 $\mu$m. The surface of the front end portion of the ejection electrode 103 is covered uniformly with an insulating layer 109 having a thickness of 10 $\mu$m or less.

The recording head in this embodiment employs a tape-shaped head where the ejection electrodes 103 are formed integrally on the base film 102. Specifically, TAB (tape automated bonding) tape that is employed in TAB is used, and the insulating layer 109 is formed by chemical deposition of parylene resin. An upper cover 401 and a lower cover 402 are attached to both surfaces of the base film 102 so that the ejection electrodes 103 protruding from the substrate 101 and the base film 102 are interposed therebetween, at a position where the protruding portions of the ejection electrodes 103 are not covered. The upper and lower covers 401 and 402 are made of an insulating material. The upper cover 401 is formed with an ink supply port 404, and the space between the base film 102 and the upper cover 401 constitutes an upper ink chamber 113 which is filled with ink supplied from the ink supply port 404. Between the front end of the upper cover 403 and the base film 102, there is formed a slit-shaped ink nozzle 403. On the other hand, the lower cover 402 is formed with an ink discharge port (not shown), and the space between the base film 102 and the lower cover 401 likewise constitutes a lower ink chamber 114.

The ink, supplied to the upper ink chamber 113 on the side of the upper cover 401, passes through the gaps between a plurality of ejection electrodes 103 from the upper ink chamber 113 and flows from the vicinity of the ink nozzle 403 to the lower ink chamber 114. Then, the ink is discharged forcibly from the ink discharge port along with an excess of toner particles. The inkjet recording head in this embodiment is connected to an ink tank (not shown) through tubes (not shown), and a negative pressure of 1 $cmH_2O$ is applied to forcibly circulate ink through the tubes. The ink is one where an electrification control agent and colored thermoplastic resin corpuscles (i.e., toner particles) are dispersed in a petroleum-base organic solvent such as an isoparaffin solvent. The toner particles are charged with an apparent positive polarity by a zeta ($\zeta$) potential.

At the inner rear end of the upper cover 401, an electrophoresis electrode 405 is provided in contact with the ink within the upper ink chamber 113. The electrophoresis electrode 405 is given voltage having the same polarity as the potential of the toner particles and moves the toner particles in the ink, supplied from an ink supply port 404, to the vicinity of an electrode 103 along the electric field generated between the electrophoresis electrode 405 and a counter electrode (not shown) by an electrophoresis phenomenon. As a consequence, in addition to the supply of the toner particles to the vicinity of the ink nozzle 403 through the compulsory ink circulation performed with a pump, because of the movement of the toner particles caused by the electrophoresis phenomenon, the concentration of the toner particles becomes relatively higher in the vicinity of the ink nozzle 403 than in the upper ink chamber 113.

Figure 19:
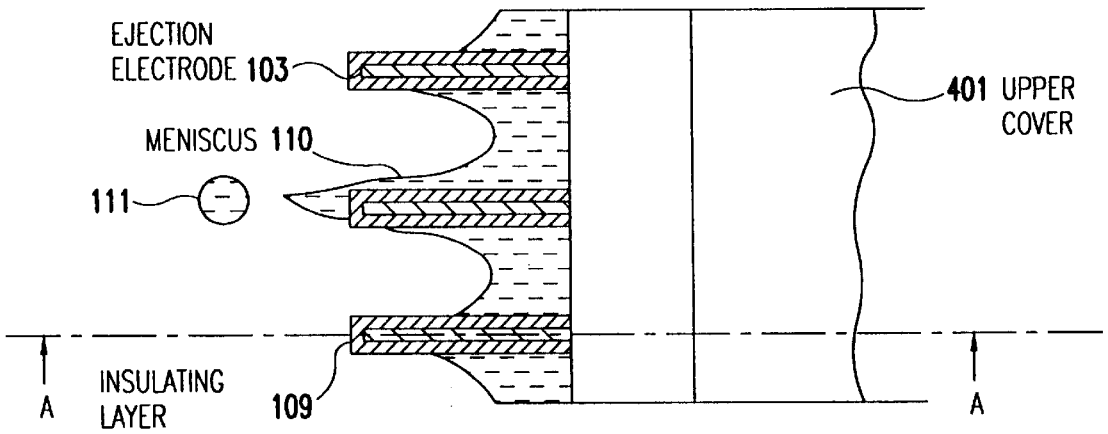
FIG. 19 is an enlarged part-plan view of the ink nozzle of the eighth embodiment shown in FIG. 18.
Figure 20:
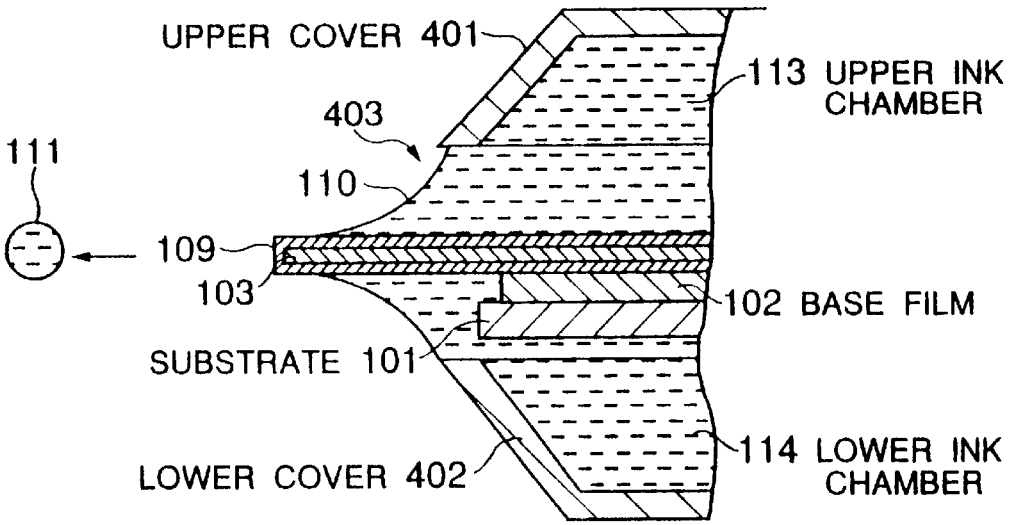
FIG. 20 is a sectional view of the ink nozzle in FIG. 19 taken substantially along line A—A of FIG. 19.

In FIGS. 19 and 20, ink forms an ink meniscus 110 in the ink nozzle 403 by its surface tension. Since negative pressure is given to the ink within the ink chambers and also the ejection electrodes 103 protrude from the substrate 101, the base film 102, the upper cover 401 and the lower cover 402, the ink meniscus 110 on the side of the upper cover 401 has a concave configuration when viewed in a horizontal direction, as shown in FIG. 20. Likewise, the ink meniscus 110 on the side of the lower cover 402 has a concave configuration. These concave configurations are substantially symmetrical with respect to the ejection electrode 103. Furthermore, because the ejection electrodes 103 individually protrude outside the ink nozzle 403, the ink meniscus 110 has a concave configuration between adjacent electrodes 103 when viewed in a vertical direction, as shown in FIG. 19.

Therefore, when a high-voltage pulse signal is applied to any one of the ejection electrodes 103, an electric field is concentrated on the protruding front end of the ink meniscus 110 of that ejection electrode 103. Then, the charged toner particles in the ink are conducted by the electric field that is generated between a counter electrode (not shown) and the ejection electrode 103. Next, the charged toner particles are pulled out of the protruding front end of the ink meniscus 110 and become a toner group 111. Consequently, the toner group 111 is jetted toward the counter electrode (not shown) arranged in opposition to the ejection electrode 103, that is, toward the recording medium. The toner group, which adhered to the recording paper and formed a recording dot, is heated and fixed by means of a heater.

Figure 21:
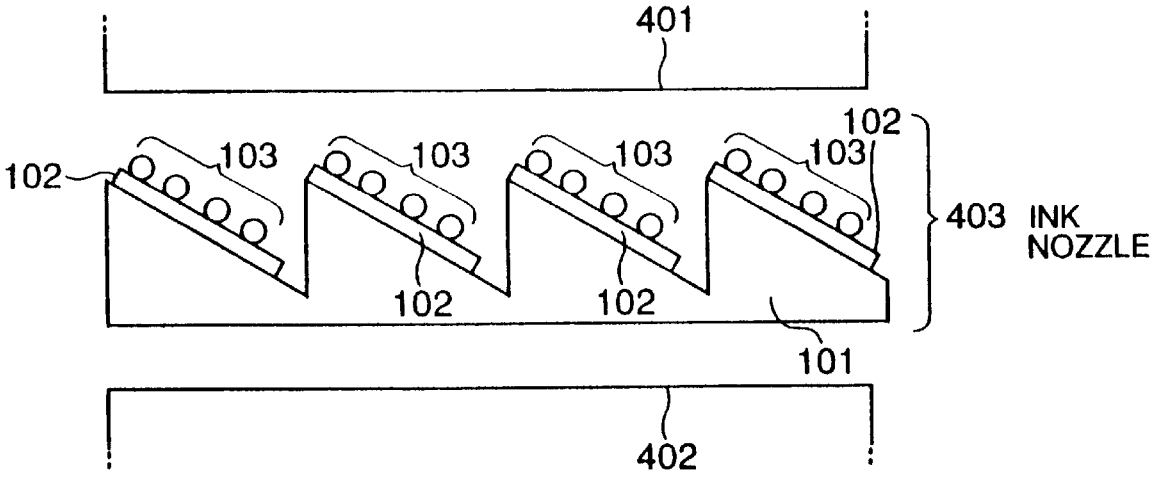
FIG. 21 is a front view of the recording head showing a layout example of the ejection electrodes in the eighth embodiment.

As shown in FIG. 21, the ejection electrodes 103, formed on the base film 102, are divided into a plurality of groups at the front end portion by slits formed in the base film 102. Also, the base-film mounting portions of the substrate 101 are inclined at a certain angle so that each ejection electrode 103 is offset (inclined) for each group when viewed from the front side. Furthermore, between the individual groups, the ejection electrodes 103 which are arranged at the same position in correspondence with the inclination are concurrently driven in the form of a matrix.

Figure 22:
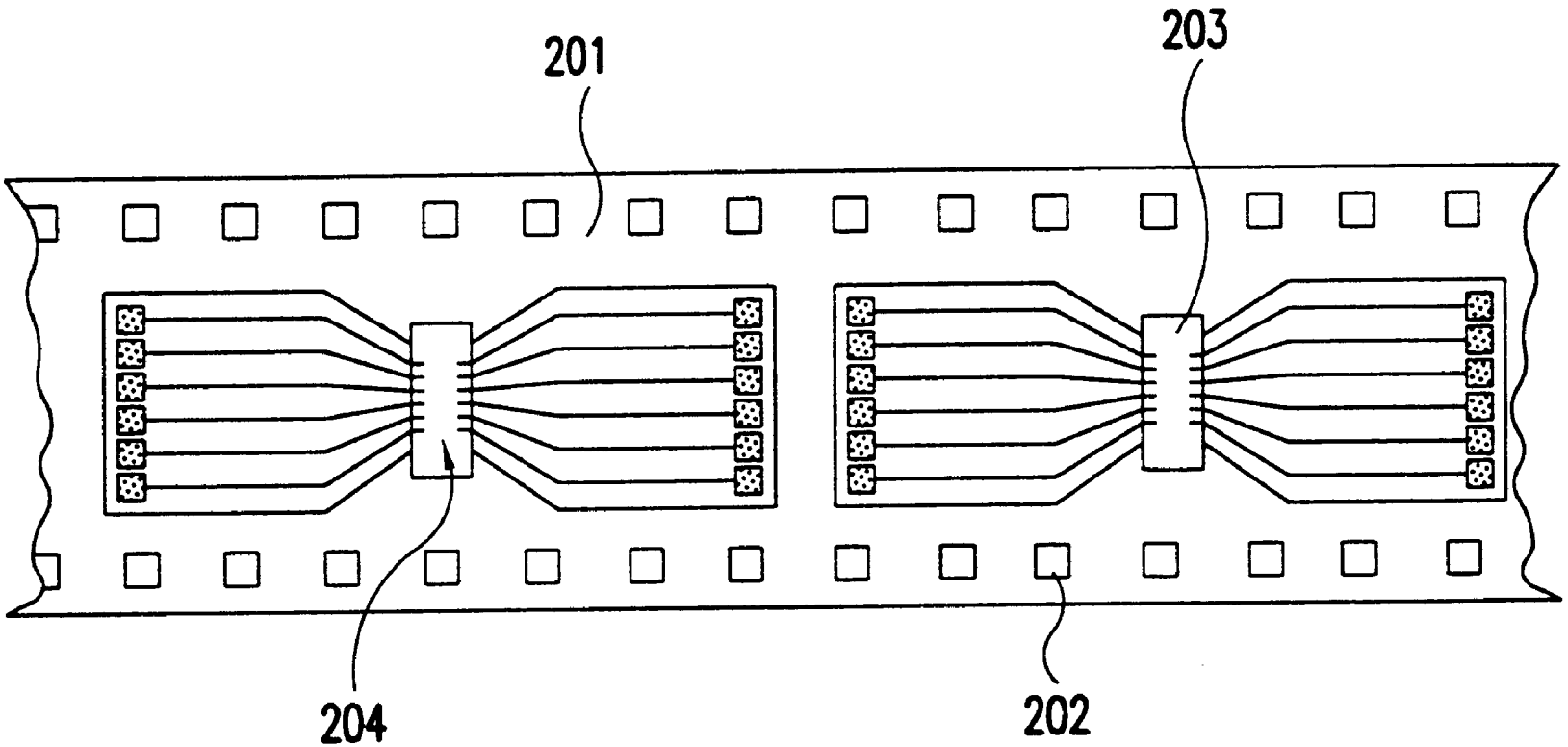
FIG. 22 is a schematic plan view of TAB tape that is used in the eighth embodiment.

In reference to FIG. 22, a brief description will be made of a method of fabricating TAB tape 201 which is used in the eighth embodiment shown in FIGS. 18 through 21. Flash plating is first given to a tape-shaped polyimide base film having sprocket holes 202 at both ends. Then, a dry film is placed on top of the plated base film, and exposure and development are performed to form a predetermined pattern. Next, the base film is plated with copper (Cu) in accordance with the predetermined pattern and is etched to form through-holes 203. Thereafter, the photoresist film is removed and finish plating is given. Finally, parylene resin is chemically deposited on a required place to form the insulating layer 109. The TAB tape 201, fabricated in this way, is employed as a recording head. In this process, when the base film 102 is etched, the exposed inner lead portions 204 form the ejection electrodes 103. The slits on the side of the inner lead portion 204 are formed by etching or cutting.

Figure 23:
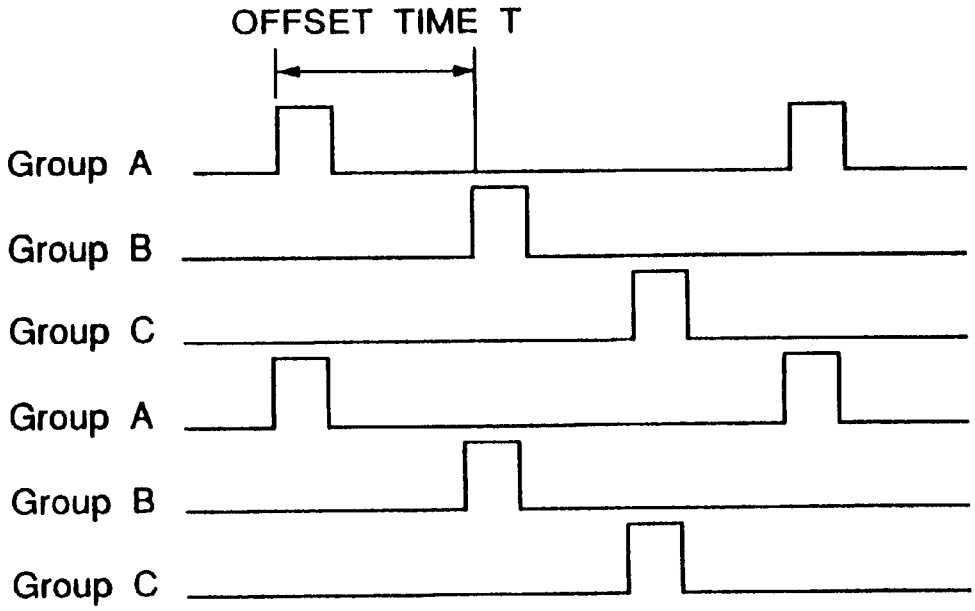
FIG. 23 is a timing diagram illustrating an example of a drive method of the ejection electrodes in the eighth embodiment.
Figure 24A:
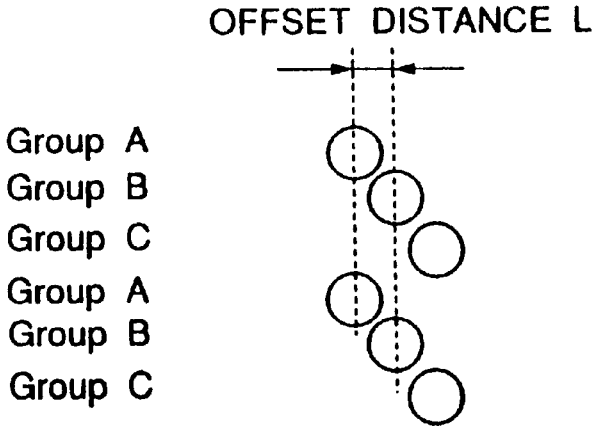
FIG. 24A is a schematic view showing the offset distance between the ejection electrodes in the eighth embodiment.
Figure 24B:
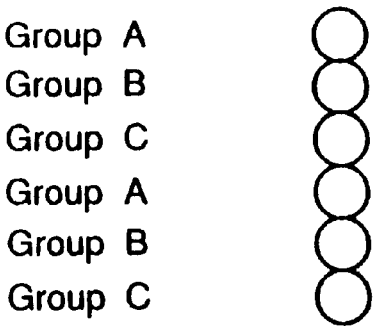
FIG. 24B is a schematic view showing an example of the printing performed by the drive method in the eighth embodiment shown in FIG. 23.

In FIGS. 23, 24A, and 24B, the corresponding ejection electrodes 103 of each group, connected electrically in the form of a matrix, are driven with a certain offset time T for each group. Consequently, if the ejection electrodes 103 are constructed physically on the same line, an offset error with offset distance L would occur in recorded dots for each group connected in the form of a matrix, as shown in FIG. 24A.

On the other hand, in the present invention, the ejection electrodes 103 have previously been offset so that the offset distance L is compensated. Consequently, as shown in FIG. 24B, position offset due to each offset time T does not occur in recorded dots, and high-quality printing is obtainable.

Also, in the recording head of the present invention, while a plurality of ejection electrodes need to be constructed with high density and accuracy, stable ejection electrode spacing and electrode protrusion quantity can be ensured by the aforementioned embodiments. In addition, the head is in the form of tape, so reductions in the thickness and size of the head become possible. Furthermore, since an excess of toner particles and an excess of counter ions are discharged forcibly from the vicinity of the ejection electrodes by constructing the head so that ink is passed through the gaps between the ejection electrodes, toner particle are stably supplied near the ejection electrodes at all times and reliable toner supply is obtained regardless of printing conditions. Moreover, the ejection electrodes, formed on base films, are offset for each base film by the offset time of a matrix drive method, so position offset due to the offset time does not occur and high-quality printing is obtained.

While the invention has been described with reference to specific embodiments thereof, it will be appreciated by those skilled in the art that numerous variations, modifications, and embodiments are possible, and accordingly, all such variations, modifications, and embodiments are to be regarded as being within the scope of the invention.

What is claimed is:

1. An inkjet recording apparatus comprising:

an insulating support member having a major surface and an opposing surface;

a plurality of linear ejection electrodes formed on the major surface of the insulating support member with an ejection portion of each ejection electrode extending beyond an ejection end of the insulating support member; and a cover member for covering the insulating support member to thereby define an ink chamber between the cover member and the insulating support member for containing an ink having ink particles, the cover member having an ejection end in contact with the ejection electrodes to so as to define respective openings between adjacent ones of the ejection electrodes and the ejection end of the cover member, wherein the ejection portion of each ejection electrode extends beyond the ejection end of the cover member.

2. The inkjet recording apparatus according to claim 1, wherein the cover member comprises an electrophoresis electrode formed thereon inside the ink chamber and opposite the ejection end thereof, the electrophoresis electrode being in contact with any ink contained in the ink chamber, wherein an electrophoresis phenomenon of the ink particles is generated when a predetermined voltage is applied to the electrophoresis electrode.

3. The inkjet recording apparatus according to claim 1, wherein the cover member comprises:

a first cover for covering the major surface of the insulating support member, wherein the first cover has an ejection end and is shaped to form an upper portion of the ink chamber between the major surface of the insulating support member and the first cover; and a second cover, separate and distinct from the first cover, for covering the opposing surface of the insulating support member, wherein the second cover has an ejection end and is shaped to form a lower portion of the ink chamber between the opposing surface of the insulating support member and the second cover, wherein the ejections ends of the first and second covers contact the ejection electrodes which extend beyond the ejection ends thereof, and wherein the openings are defined between adjacent ones of the ejection electrodes and the first and second covers.

4. The inkjet recording apparatus according to claim 3, wherein the first cover comprises an electrophoresis electrode formed thereon inside the upper portion of the ink chamber and opposite the ejection end thereof, the electrophoresis electrode being in contact with any ink contained in the ink chamber, wherein an electrophoresis phenomenon of the ink particles is generated when a predetermined voltage is applied to the electrophoresis electrode.

5. The inkjet recording apparatus according to claim 4, wherein the second cover comprises an electrophoresis electrode formed thereon inside the lower portion of the ink chamber and opposite the ejection end thereof, the electrophoresis electrode being in contact with any ink contained in the ink chamber, wherein an electrophoresis phenomenon of the ink particles is generated when a predetermined voltage is applied to the electrophoresis electrode.

6. The inkjet recording apparatus according to claim 3, wherein ink contained in the upper portion of the ink chamber may be supplied to the ejection portion of the ejection electrodes for ejection, and may be supplied into the lower portion of the ink chamber by flowing from the upper portion of the ink chamber and between adjacent ones of the ejection electrodes.

7. The inkjet recording apparatus according to claim 1, wherein the insulating support member comprises:

an insulating substrate having an election end; and an insulating base film fixed on the insulating substrate, wherein the ejection electrodes are formed on the insulating base film and extend beyond the ejection end of the insulating substrate.

8. The inkjet recording apparatus according to claim 7, wherein the insulating base film has an election end, and the ejection electrodes extend beyond the ejection end of the insulating base film.

9. The inkjet recording apparatus according to claim 7, wherein the insulating base film has a plurality of protruding portions supporting the ejection portions of the ejection electrodes, respectively.

10. The inkjet recording apparatus according to claim 7, wherein the insulating base film is formed using a TAB (tape automated bonding) tape.

11. The inkjet recording apparatus according to claim 7, wherein the insulating base film has an ejection end, and wherein the ejection end of the insulating base film extends beyond the ejection portion of the ejection electrodes.

12. The inkjet recording apparatus according to claim 1, wherein at least the ejection portions of each of the ejection electrodes are coated with an insulating material.

13. An inkjet recording apparatus, comprising:

an insulating support member having a major surface and an opposing surface;

a plurality of linear ejection electrodes formed on the major surface of the insulating support member with an ejection portion of each ejection electrode extending beyond an ejection end of the insulating support member, wherein the plurality of ejection electrodes are divided into a plurality of groups, each group including a predetermined number of ejection electrodes such that corresponding electrodes of each group are arranged and configured to be concurrently driven; and a cover member for covering the insulating support member to thereby define an ink chamber between the cover member and the insulating support member for containing an ink having ink particles, the cover member having an ejection end such that the ejection portion of each ejection electrode extends beyond the ejection end of the cover member.

14. The inkjet recording apparatus according to claim 13, wherein the insulating support member comprises:

an insulating substrate having an ejection end which is saw-tooth shaped; and an insulating base film fixed on the insulating substrate and having an ejection end such that the ejection end of the base film has slits formed therethrough to form a number of sections which are each fixed to a corresponding surface of a tooth of the insulating substrate ejection end, wherein, for each group of ejection electrodes, the ejection portions of the ejection electrodes in the group are formed on one of the sections of the base film such that each group of ejection electrodes and corresponding base film section is inclined at a predetermined angle with respect to the major surface of the insulating support member, with each ejection electrode within a group being at a different elevation, wherein the ejection electrodes at the same elevation level among each of the groups are connected so as to be concurrently driven, and wherein the ejection portion of each ejection electrode extends beyond the ejection end of the insulating substrate.

15. The inkjet recording apparatus according to claim 14, wherein the insulating base film is formed using a TAB (tape automated bonding) tape.

16. The inkjet recording apparatus according to claim 13, wherein the cover member comprises an electrophoresis electrode formed thereon inside the ink chamber and opposite the ejection end thereof, the electrophoresis electrode being in contact with any ink contained in the ink chamber, wherein an electrophoresis phenomenon of the ink particles is generated when a predetermined voltage is applied to the electrophoresis electrode.

17. The inkjet recording apparatus according to claim 13, wherein the cover member comprises:

a first cover for covering the major surface of the insulating support member, wherein the first cover has an ejection end and is shaped to form an upper portion of the ink chamber between the major surface of the insulating support member and the first cover; and a second cover, separate and distinct from the first cover, for covering the opposing surface of the insulating support member, wherein the second cover has an ejection end and is shaped to form a lower portion of the ink chamber between the opposing surface of the insulating support member and the second cover, wherein the ejections ends of the first and second covers form an opening therebetween, through which the ejection portions of the ejection electrodes extend.

18. The inkjet recording apparatus according to claim 17, wherein the first cover comprises an electrophoresis electrode formed thereon inside the upper portion of the ink chamber and opposite the ejection end thereof, the electrophoresis electrode being in contact with any ink contained in the ink chamber, wherein an electrophoresis phenomenon of the ink particles is generated when a predetermined voltage is applied to the electrophoresis electrode.

19. The inkjet recording apparatus according to claim 13, wherein at least the ejection portions of each of the ejection electrodes are coated with an insulating material.

20. An inkjet recording apparatus comprising:

an insulating support member having a major surface and an opposing surface;

a plurality of linear ejection electrodes formed on the major surface of the insulating support member with an ejection portion of each ejection electrode extending beyond an ejection end of the insulating support member; and a cover member for covering the insulating support member to thereby define an ink chamber between the cover member and the insulating support member for containing an ink having ink particles, the cover member having an ejection end such that the ejection portion of each ejection electrode extends beyond the ejection end of the cover member, the cover member including an electrophoresis electrode formed thereon inside the ink chamber and opposite the ejection end thereof, the electrophoresis electrode being in contact with any ink contained in the ink chamber, wherein an electrophoresis phenomenon of the ink particles is generated when a predetermined voltage is applied to the electrophoresis electrode.

21. The inkjet recording apparatus according to claim 20, wherein the cover member comprises:

a first cover for covering the major surface of the insulating support member, wherein the first cover has an ejection end and is shaped to form an upper portion of the ink chamber between the major surface of the insulating support member and the first cover; and a second cover, separate and distinct from the first cover, for covering the opposing surface of the insulating support member, wherein the second cover has an ejection end and is shaped to form a lower portion of the ink chamber between the opposing surface of the insulating support member and the second cover, wherein the ejections ends of the first and second covers form an opening therebetween, through which the ejection portions of the ejection electrodes extend.

22. The inkjet recording apparatus according to claim 21, wherein the electrophoresis electrode is formed on the first cover inside the upper portion of the ink chamber and opposite the ejection end thereof, the electrophoresis electrode being in contact with any ink contained in the ink chamber, wherein an electrophoresis phenomenon of the ink particles is generated when a predetermined voltage is applied to the electrophoresis electrode.

23. The inkjet recording apparatus according to claim 22, wherein the second cover comprises an electrophoresis electrode formed thereon inside the lower portion of the ink chamber and opposite the ejection end thereof, the electrophoresis electrode being in contact with any ink contained in the ink chamber, wherein an electrophoresis phenomenon of the ink particles is generated when a predetermined voltage is applied to the electrophoresis electrode.

24. The inkjet recording apparatus according to claim 20, wherein at least the ejection portions of each of the ejection electrodes are coated with an insulating material.

* * * * *

UNITED STATES PATENT AND TRADEMARK OFFICE

CERTIFICATE OF CORRECTION

PATENT NO. : 6,213,591 B1
DATED : April 10, 2001
INVENTOR(S) : Junichi Suetsugu, Kazuo Shima, Ryosuke Uematsu, Tadashi Mizoguchi, Hitoshi Minemoto, Hitoshi Takemoto, Yoshihiro Hagiwara, Toru Yakushiji It is certified that error appears in the above-identified patent and that said Letters Patent is hereby corrected as shown below:

Title page,
Item [54], please correct the title from: "INJET RECORDING APPARATUS" to -- INJET RECORDING APPARATUS --.

Signed and Sealed this

Sixth Day of November, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,213,591 B1
DATED : April 10, 2001
INVENTOR(S) : Junichi Suetsugu, Kazuo Shima, Ryosuke Uematsu, Tadashi Mizoguchi, Hitoshi Minemoto, Hitoshi Takemoto, Yoshihiro Hagiwara, Toru Yakushiji It is certified that error appears in the above-identified patent and that said Letters Patent is hereby corrected as shown below:

Title page,
Item [54], please correct the title from: "INJET RECORDING APPARATUS" to -- INKJET RECORDING APPARATUS --.

This certificate supersedes certificate of correction issued November 6, 2001.

Signed and Sealed this

Fifteenth Day of January, 2002

*Attest:*

*Attesting Officer*

JAMES E. ROGAN
*Director of the United States Patent and Trademark Office*